United States Patent [19]

Junkers

[11] Patent Number: 5,029,497

[45] Date of Patent: Jul. 9, 1991

[54] CONTINUOUS RATCHET DRIVE

[76] Inventor: John K. Junkers, 7 Arrowhead La., Saddle River, N.J. 07458

[21] Appl. No.: 259,757

[22] Filed: Oct. 19, 1988

[51] Int. Cl.[5] ..... B25B 13/46

[52] U.S. Cl. ..... 81/57.39

[58] Field of Search ..... 81/57.39

[56] References Cited

U.S. PATENT DOCUMENTS

| | | | |
|---|---|---|---|
| 4,027,561 | 6/1977 | Junkers | 81/57.39 |
| 4,409,865 | 10/1983 | Krautter et al. | 81/57.39 |
| 4,644,829 | 2/1987 | Junkers | 81/57.39 |
| 4,669,338 | 6/1987 | Collins | 81/57.39 |

*Primary Examiner*—James G. Smith

*Attorney, Agent, or Firm*—Michael J. Striker

[57] ABSTRACT

A continuous ratchet drive for a fluid-operated wrench or the like comprises a support, a ratchet gear mounted on the support means turnably about a first pivot axis and having a plurality of ratchet teeth, a lever pivotable about a second pivot axis extending laterally from and parallel to the first pivot axis under the action of a drive, and two pawl elements pivotally connected with the lever means in pivot points which are spaced from the second pivot axis, the pawl elements being formed so that during pivoting of the lever in one direction one of the pawl elements engages with the teeth of the ratchet gear and turns the ratchet gear in one direction, while during pivoting the lever in an opposite direction the other of the pawl elements engages with the teeth of the ratchet gear and turns the ratchet gear in the same direction, each of the pawl elements including a supporting member having one end which is pivotally connected with the lever in a respective one of the pivot points and another end, and a pawl member which is pivotally connected with the other end of the supporting member and engages with the teeth of the ratchet gear during respective pivoting of the lever.

1 Claim, 3 Drawing Sheets

FIG. 2
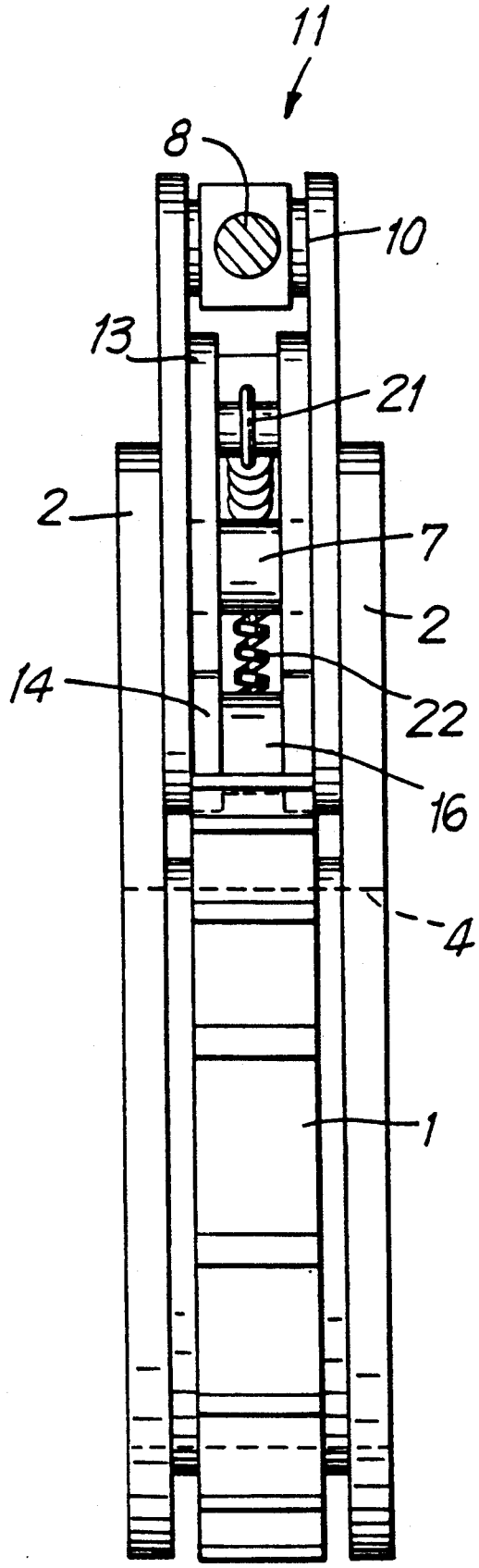
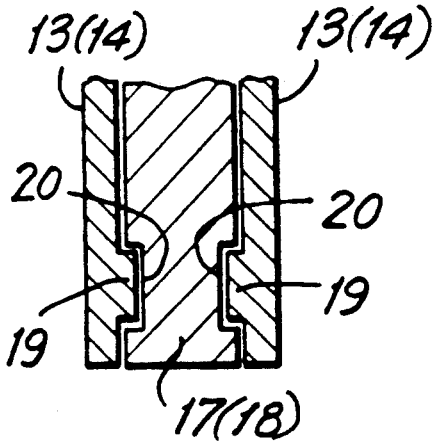
FIG. 3

CONTINUOUS RATCHET DRIVE

BACKGROUND OF THE INVENTION

The present invention relates to ratchet drives, in particular for fluid operated wrenches and the like.

Continuous ratchet drives are known in the art. One of the known drives includes a ratchet gear and a pivoting lever arm which turns the ratchet gear during the advance stroke of a cylinder-piston unit, and also during the return stroke of the same. It has been found that since the tip of a pawl connected with the lever arm and engaging with the ratchet tooth moves relative to the ratchet tooth during a power stroke, a considerable friction is created and the ratchet teeth deteriorate with consistent use.

One of the solutions to eliminate this movement is proposed in the U.S. Pat. No. 4,644,829. However, this tool has a very complicated construction and is expensive to manufacture since it requires many parts.

SUMMARY OF THE INVENTION

Accordingly, it is an object of the present invention to provide a continuous ratchet drive, particularly for a fluid operated wrench, which avoids the disadvantages of the prior art.

More particularly it is an object of the present invention to provide a continuous ratchet drive particularly for a fluid operated wrench, which substantially eliminates the friction between the teeth of the ratchet gear and the pawl and at the same time has a simple construction.

In keeping with these objects and with others which will become apparent hereinafter, one feature of the present invention resides, briefly stated, in a continuous ratchet drive which has a ratchet gear pivotable about a first axis, a lever arm pivotable about a second axis which is parallel to said first axis by a fluid operated cylinder-piston unit, and two pawl elements arranged so that during an advance stroke of the cylinder-piston units one of the pawl elements engages the teeth of ratchet gear and turn it in one direction, while during a return stroke of the cylinder-piston unit the other of the pawl elements engages with the teeth of the ratchet gear and turns the ratchet gear in the same direction, wherein each pawl element includes a supporting member having one end pivotally connected with the lever arm, and a pawl member pivotally connected with another end of the supporting member.

When the ratchet drive is designed in accordance with the present invention, the tooth of the pawl members substantially does not move relative to the tooth of the ratchet wheel and therefore the friction between the teeth is substantially reduced. Also the pawl members can be made flat with no bends in an axial direction so as to eliminate undesirable loads.

The novel features which are considered as characteristic for the invention are set forth in particular in the appended claims The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a side view of a continuous ratchet drive of FIG. 1;

FIG. 3 is a view showing a cross-section taken along the line III—III in FIG. 1;

DESCRIPTION OF THE PREFERRED EMBODIMENTS

Figure 1:
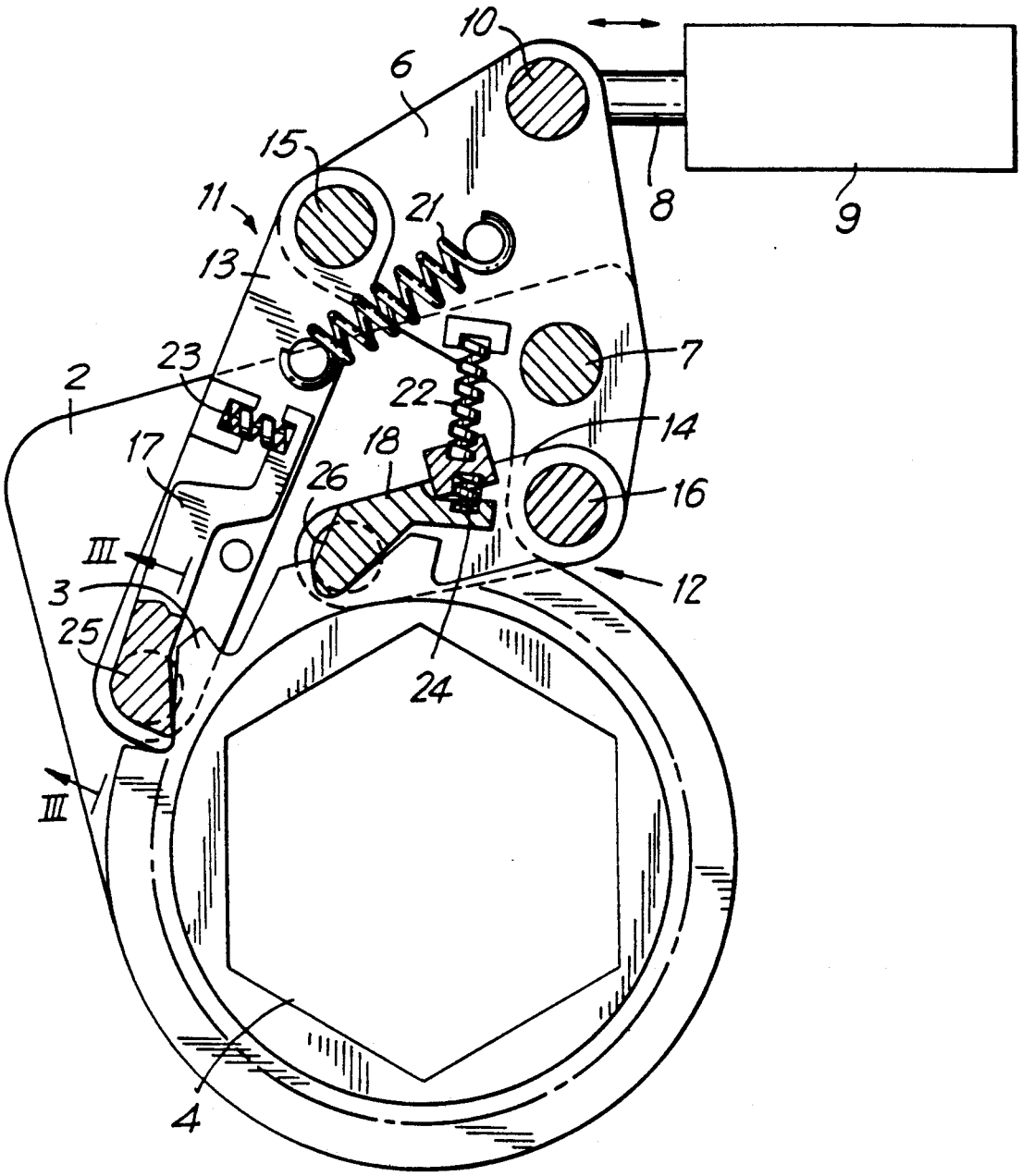
FIG. 1 is a view showing a front view of a continuous ratchet drive in accordance with one embodiment of the present invention.

A continuous ratchet drive in accordance with the present invention is used, for example, in a fluid-operated wrench. The continuous ratchet drive in accordance with one embodiment shown in FIG. 1 has a ratchet gear 1 which is turnably mounted in a housing 2 of the fluid-operated wrench and has a plurality of teeth 3 and a central engaging member 4. The other is formed for example as a hexagonal axial projection for attaching standard sockets which can engage threaded connectors, such as nuts, bolt heads, etc., for tightening or loosening the latter.

The ratchet drive further includes a pivotable lever arm 6 which is pivotally mounted in the housing 2 for example by means of a pivot pin 7. The lever arm 6 has a somewhat triangular shape. Its one corner is pivotally connected with a piston rod 8 of a cylinder-piston drive unit 9, for example by a pivot pin 10.

The continuous ratchet drive of the invention is further provided with two pawl elements which are identified as a whole with reference numerals 11 and 12. Each pawl element 11 and 12 has two supporting plates 13 and 14 respectively. One end of the supporting plates 13 of the pawl element 11 is connected with one corner of the pivoting arm 6 for example by a pivot pin 15, while one end of the supporting plates 14 of the pawl element 12 is connected with the other corner of the lever arm 6 for example by means of a pivot pin 16. Each pawl element 11 and 12 further includes a pawl member 17 and 18 respectively. The pawl member 17 is arranged between the plates 13 and pivotable relative to the latter. The pawl member 18 is arranged between the plates 14 and pivotable relative to the latter. The pivoting can be performed for example as shown in FIG. 3, by means of circular projections 19 provided on the plates and engaging in circular holes 20 provided in the pawl member.

The pawl member 11 is spring-biased toward the lever arm 6 by a tension spring 21 while the pawl element 12 is biased away of the lever arm 6 by a pressure spring 22. Also, the pawl member 17 can be biased relative to the plates 13 of the pawl element 11 by a tension spring 23, while the pawl member 18 can be biased relative to the plates 14 of the pawl element 12 by means of a pressure spring 24'.

As can be seen from the drawings, the teeth 3 of the ratchet gear 1 have a shape with a steep front flank and a shallow rear flank, while the teeth are separated from one another by gaps having substantially rounded bottom portions. The pawl members 17 and 18 have teeth 25 and 26 with a shape which substantially corresponds to the shape of the gaps between the teeth 3 of the ratchet gear 1.

During the operation of the inventive continuous ratchet drive, the piston rod of the cylinder-piston drive unit 9 displaces for example to the left in the drawing, the lever arm 6 turns in a counterclockwise direction, the pawl element 11 is pushed downwardly in the drawing, and the tooth 25 of the pawl member 17 engages in the gap between the teeth of the ratchet gear 1 and turns the latter in the counterclockwise direction. The tooth 25 of the ratchet member 17 automatically adjusts to the shape of the gap between the teeth 3 so that substantially no friction occurs between the tooth of the pawl member and the teeth of the ratchet gear. During the reverse stroke of the cylinder-piston unit 9 and the displacement of the piston rod 8 to the right in the drawing, the lever arm 6 is turned in a clockwise direction, the tooth 26 of the pawl element 12 is pushed into a gap between the teeth 3 of the ratchet gear and turns the ratchet gears also in the counterclockwise direction. The tooth 26 automatically adjusts to the shape of the gap between the teeth 3 so that substantially no friction occurs between the tooth of this pawl member and the teeth of the ratchet gear.

Figure 4:
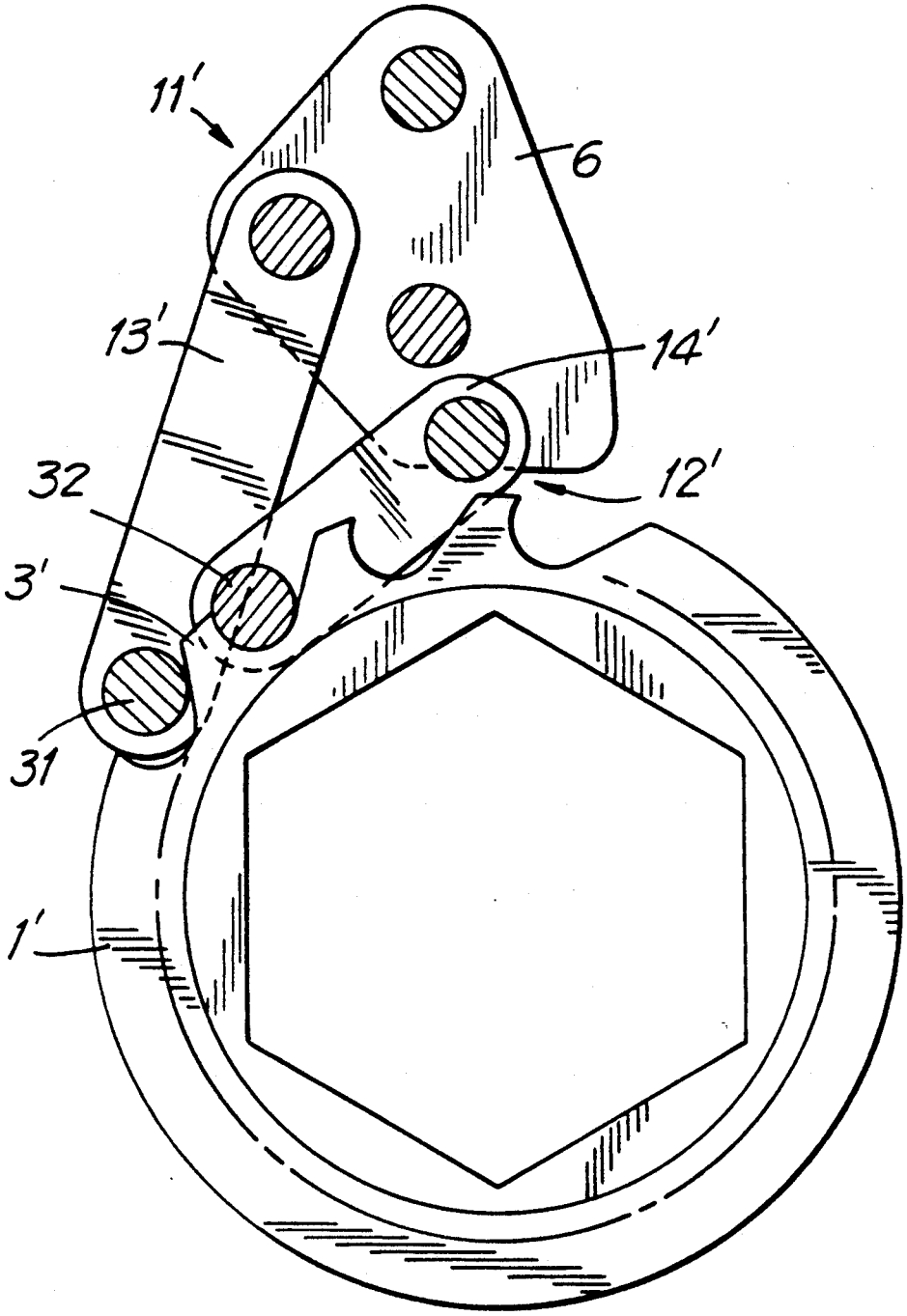
FIG. 4 is a view showing a continuous ratchet drive in accordance with another embodiment of the present invention.

FIG. 4 shows a continuous ratchet drive in accordance with another embodiment of the invention. In this embodiment the pivotable lever arm also cooperates with the ratchet gear 11 through two pawl elements 11' and 12'. Each of the pawl elements 11' and 12' has also two plates 13' and 14' which are substantially similar to the plates 13 and 14 of the embodiment of FIG. 1. However, each of the pawl elements 11' and 12' has a pawl member 31 and 32 respectively which is formed differently from the pawl members of the embodiment of FIG. 1. The pawl members 31 and 32 are formed as cylindrical pins which are pivotally received in respective ends of the plates 13' and 14'. The teeth 3' of the ratchet gear 1' are formed in a somewhat different manner. The gaps between the teeth have a contour with a part which is formed by a cylindrical surface corresponding to the cylindrical surface of the pins 31 and 32.

It is to be understood that the inventive principle can be used also in discontinuous ratchet drives with only one pawl element which turns the ratchet gear during the advance stroke of the drive unit and just slips over the ratchet teeth during the return stroke.

It will be understood that each of the elements described above, or two or more together, may also find a useful application in other types of constructions differing from the types described above.

While the invention has been illustrated and described as embodied in a continuous ratchet drive for fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A continuous ratchet drive for a fluid-operated wrench or the like, comprising support means; a ratchet gear mounted on said support means turnably about a first pivot axis and having a plurality of ratchet teeth; lever means pivotable about a second pivot axis extending laterally from and parallel to said first pivot axis, under the action of a drive; two pawl elements pivotally connected with said lever means in pivot points which are spaced from said second pivot axis, said pawl elements being formed so that during pivoting of said lever means in one direction one of said pawl elements engages with said teeth of said ratchet gear and turns said ratchet gear in one direction, while during pivoting said lever means in an opposite direction the other of said pawl elements engages with said teeth of said ratchet gear and turns said ratchet gear in the same one direction, each of said pawl elements including a supporting member having one end which is pivotally connected with said lever means in a respective one of said pivot points and another end, and a pawl member which is pivotally connected with the other end of said supporting member and engages with said teeth of said ratchet gear during respective pivoting of said lever means; spring means arranged to bias said pawl elements as a whole relative to said lever means and toward said teeth of said ratchet gear; and additional spring means arranged to bias each of said pawl members relative to a respective one of said supporting members and toward said teeth of said ratchet gear.

* * * * *